United States Patent [19]

Mitts

[11] Patent Number: 4,738,495

[45] Date of Patent: Apr. 19, 1988

[54] ROTARY HALF-MOON SHELF ASSEMBLY WITH ROTATION RESTRICTION DEVICE

[75] Inventor: Richard K. Mitts, Fullerton, Calif.

[73] Assignee: Rev-A-Shelf, Inc., Jeffersontown, Ky.

[21] Appl. No.: 938,867

[22] Filed: Dec. 8, 1986

[51] Int. Cl.[4] ..... A47F 52/02

[52] U.S. Cl. ..... 312/305; 312/311; 312/322; 211/131; 211/144; 108/94; 108/140

[58] Field of Search ..... 211/144, 131; 108/94, 108/139, 140; 312/305, 311, 238, 322

[56] References Cited

U.S. PATENT DOCUMENTS

| | | | |
|---|---|---|---|
| 3,467,432 | 9/1969 | Sullivan | 312/312 X |
| 3,982,800 | 9/1926 | Gorton et al. | 312/305 |
| 4,124,262 | 11/1978 | Schill | 312/305 |
| 4,582,372 | 4/1986 | Cooper | 312/322 |
| 4,632,474 | 12/1986 | Ingersoll | 312/305 |

*Primary Examiner*—Joseph Falk

*Attorney, Agent, or Firm*—Scott R. Cox

[57] ABSTRACT

A half-moon rotary shelf assembly having shelves mounted on a vertical post that is connected to cabinet frame by securing it to a bottom mounting assembly which is itself secured to the floor of the cabinet. The half-moon shelf assembly is adaptable for use in a dead-end storage corner cabinet. The half-moon shelf can also be secured to slides to allow the shelf to be slidably extended from the cabinet to provide additional access to the shelf. A rotation restriction means can be placed over the shaft to prevent destructive rotation of the half-moon shelf both within the cabinet and when the shelf is in its extended position.

23 Claims, 5 Drawing Sheets

ROTARY HALF-MOON SHELF ASSEMBLY WITH ROTATION RESTRICTION DEVICE

BACKGROUND OF INVENTION

1. Field of Invention

This invention relates to a rotary shelf assembly. In particular, this invention involves a rotary, half-moon shaped, shelf storage assembly and a device for prevention of undesired rotation of the half-moon shelf.

2. Prior Art

In an effort to more fully utilize kitchen space, various rotatable shelf units have been produced. There are many different shapes of cabinets for which rotatable shelving units are practical. For example, rotatable lazy Susan assemblies have long been used to provide space in corner kitchen cabinets. Such assemblies are particularly popular because they provide easy access to hard to reach areas of a corner cabinet. See, for example, U.S. Pat. Nos. 4,181,037 and 3,982,800.

Another common kitchen storage problem area is the area within a blind or dead-end cabinet where full frontal access to the cabinet is limited. Such cabinets are located in areas, for example, next to appliances, such as stoves or refrigerators. With this type of cabinet, that portion of the space which is away from the opening of the door frequently becomes unused because of this inaccessibility.

One means for alleviating this problem is by use of a rotational storage device, such as is disclosed in U.S. Pat. No. 4,582,372. This device is drawn out from the cabinet to an extended position on a retractable guidance and support system. This device, however, requires complicated rotational and mechanical features contained both within the base of the shelf and below the cabinet. Such a complicated device is expensive to manufacture, unreliable, because of the large number of parts involved, and does not provide the opportunity for a second such retractable shelf to be located above the first shelf.

For other half-moon shaped drawers, see U.S. Pat. Nos. 4,146,280 and 3,075,820. Neither of these devices is adaptable for use in a kitchen cabinet.

Although normal rotatable Lazy Susan assemblies can also be used to provide storage space in blind or dead end corners, access to the stored objects on the inside back of the shelf is still limited since the maximum allowable rotation of such a shelf is only 90 degrees. Further, normal Lazy Susan assemblies, even with a detent mechanism, such as is disclosed in U.S. Pat. No. 3,982,800, will not prevent excess destructive rotation within a cabinet by the shelf, which can damage both the shelf assembly and the inside of the cabinet.

Therefore, it is an object of this invention to provide a low-cost, uncomplicated, rotary, half-moon shelf storage assembly for installation within dead end or blind cabinets.

It is another purpose of this invention to provide a rotary half-moon shelf storage assembly which will slide out from the cabinet for easy access to all stored items resting on the shelf.

It is a still further object of this invention to restrict the rotation of the shelf by a movement restriction means to prevent damage to the rotary half-moon shelf storage unit or the cabinet.

It is the still further object of the invention to provide a rotary, half-moon shelf storage assembly which can support a plurality of rotary, half-moon, retractable, shelves, each independent in operation from that of the other shelves.

Other objects and features of the present invention will become apparent from the consideration of the following description. The description along with the accompanying drawings provides a selected example of construction to illustrate the invention.

SUMMARY OF INVENTION

In accordance with the present invention, there is provided a rotary half-moon, shelf storage device for use in a cabinet where full frontal access is limited, comprising:

a. tubular vertical post means;

b. a means for securing the post means within the cabinet;

c. a half-moon shelf support means rotatably associated with the post means to allow rotation of the shelf support means about the axis of the post means;

d. a shelf, in the shape of a half-moon, slidably secured to the shelf support means; and e. a rotation restriction means for limiting the rotation of the half-moon shelf about the axis of the post means.

This rotary, half-moon shelf, storage device provides convenient access to the dead-end storage space in a corner cabinet. By attaching slides to a half-moon shelf, the shelf can be slidably extended from the cabinet to provide improved access to the back portion of the shelf. Further, by use of a movement restriction means, the rotary, half-moon shelf, storage device can be rotated within the cabinet in a safe, non-destructive operation. The movement restriction means will also prevent undesired rotation of the half-moon shelf when it is extended from the cabinet.

BRIEF DESCRIPTION OF THE DRAWINGS

The invention will now be described with reference to the accompanying drawings in which.

DETAILED DESCRIPTION OF PREFERRED EMBODIMENT

Figure 1:
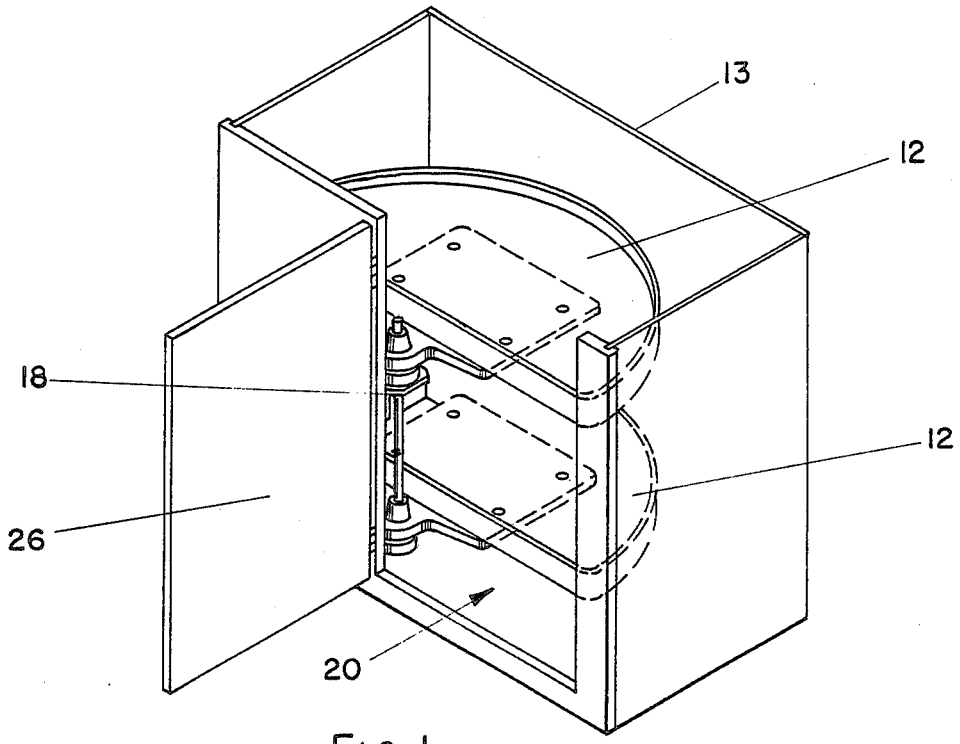
FIG. 1 is a front prospective view of a rotary, half-moon shelf storage assembly showing two shelves, each of which is in its unrotated position in a corner cabinet.
Figure 2:
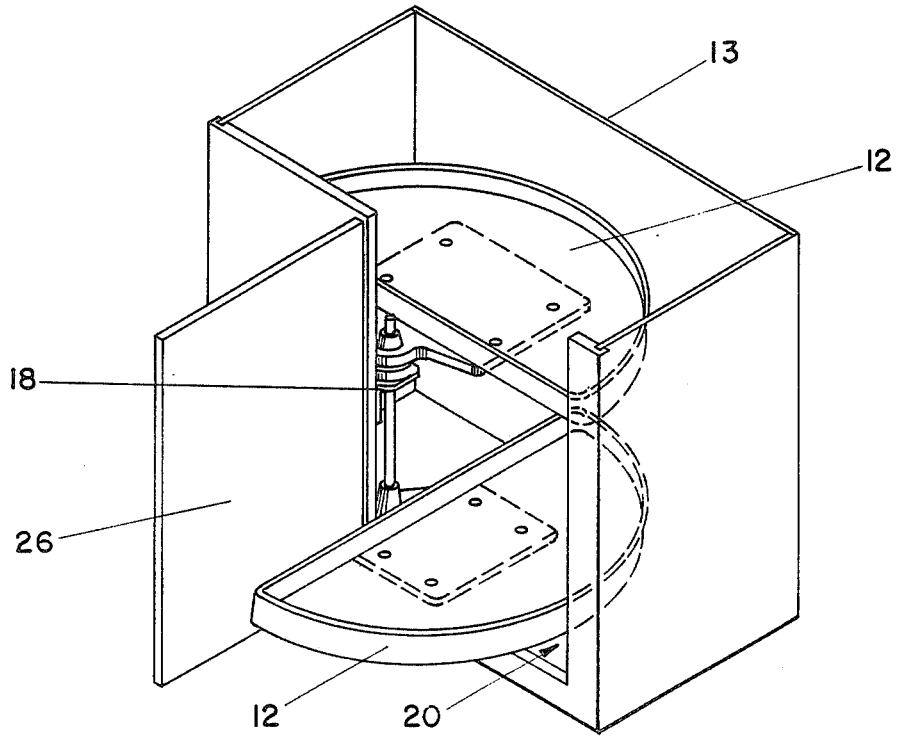
FIG. 2 is a front prospective view of the rotary, half-moon shelf storage assembly with two shelves, showing the bottom shelf in its rotated position.
Figure 3:
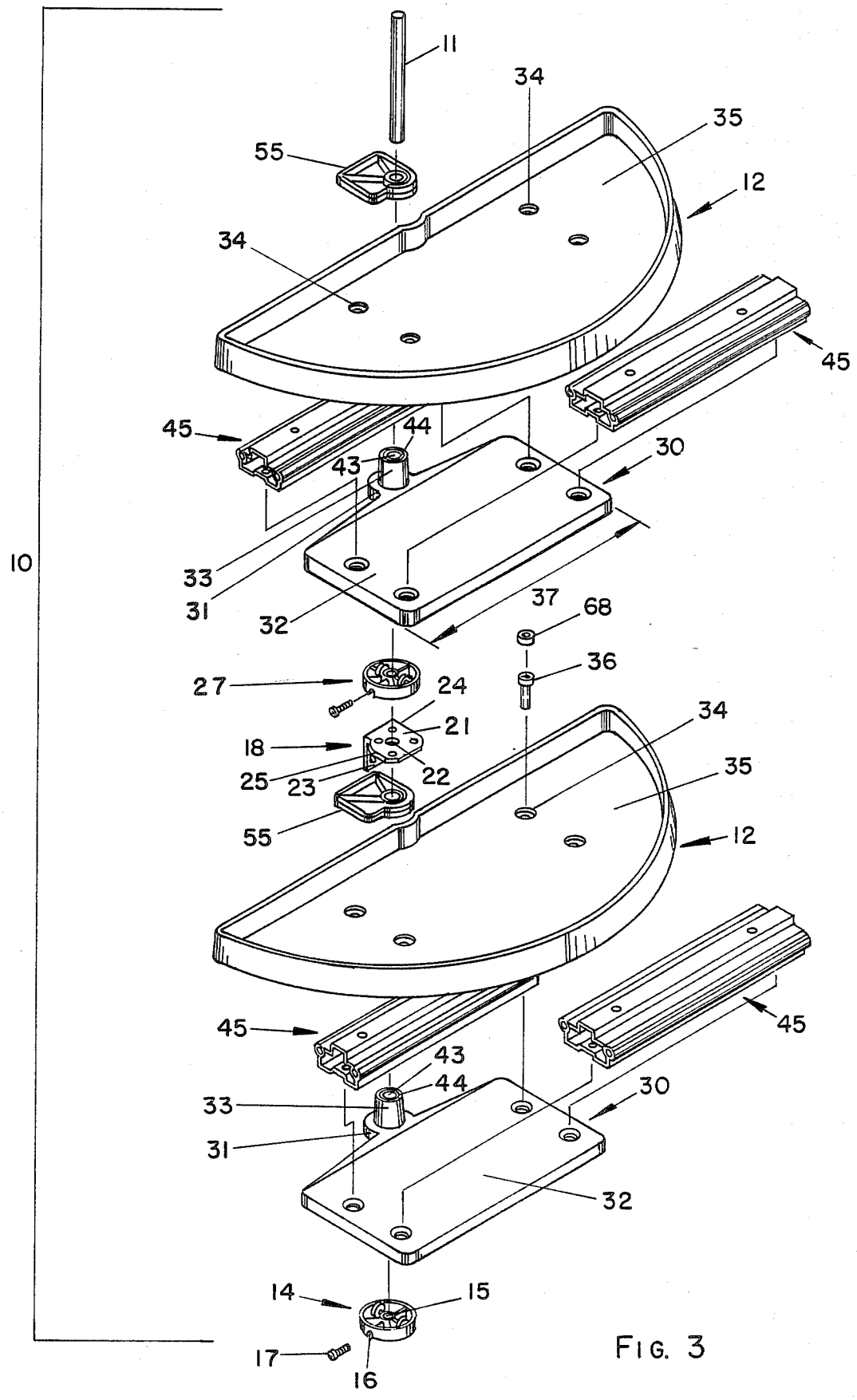
FIG. 3 is an exploded view of the rotary, half-moon shelf storage assembly with movement restriction device.

Although the invention is applicable to a wide variety of uses, it is shown on the drawings for the purpose of illustration as embodied in a half-moon shelf storage assembly (10) including a hollow tubular vertical post (11), preferably hollow, supporting one or more shelves within a blind or dead-end corner base cabinet (13). (See FIGS. 1, 2 and 3). It is understood that although this half-moon shelf storage assembly (10) can be used for other types of cabinets, it is preferably utilized to provide easy access to the dead storage space on the inside of a blind or dead end corner cabinet where full frontal access is limited. It is also understood that although this shelf storage assembly preferably utilizes a generally semicircular or approximately a 180 degree shelf, a shelf or less than 180 degrees may also be utilized in this rotary shelf assembly. Other shapes for the shelf can also be used with this assembly.

Figure 5:
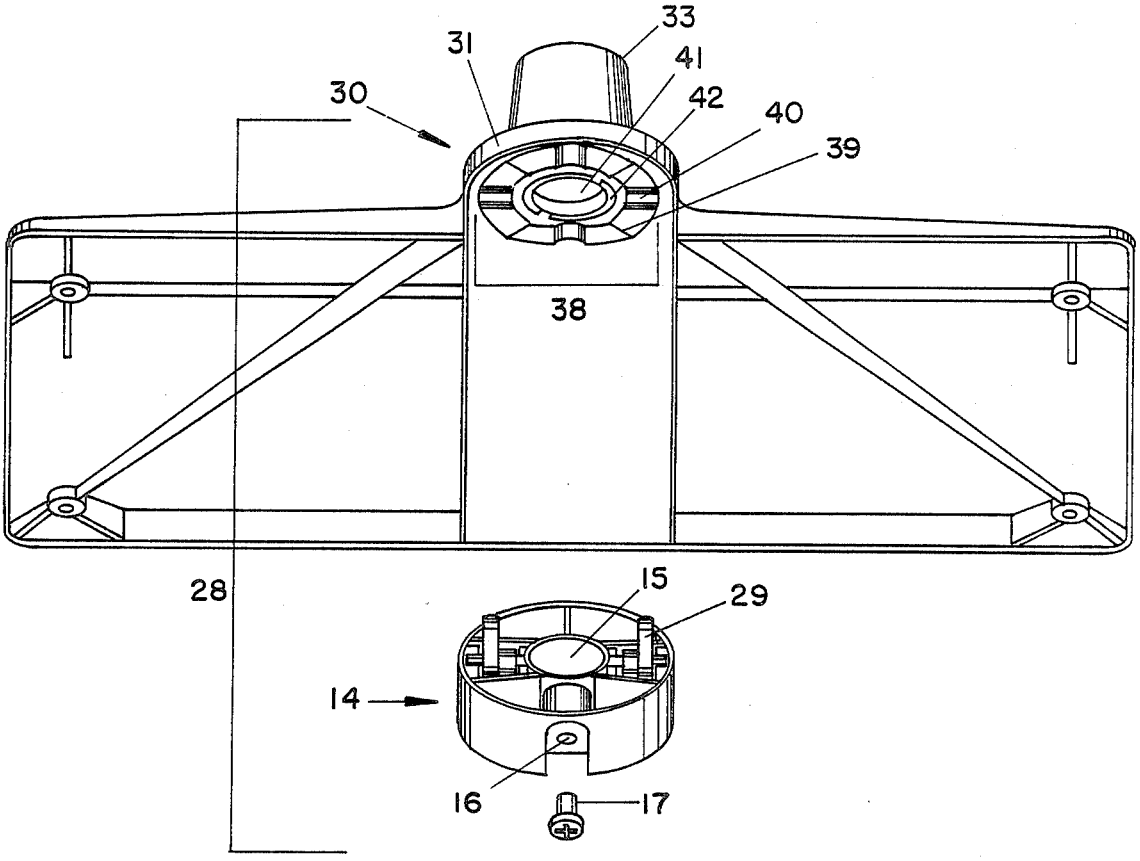
FIG. 5 is a detent mechanism for the rotary, half-moon shelf storage assembly.

The tubular vertical post (11) is attached to the floor (20) of the cabinet (13) by securing it to a bottom mounting assembly (14) which is itself secured to the floor of the cabinet by any conventional means such as wood screws. The bottom mounting assembly (14) is comprised of a circular disk containing an opening (15) for insertion of the end of the tubular vertical post, a threaded aperture (16) running through the disk through which a set screw (17) can be secured against the side of the tubular vertical post (11) to prevent rotation of the post, and the lower portion of a detent mechanism (28). (See FIG. 5). The lower portion of the detent mechanism is comprised of a rotational means arranged so as to roll about the vertical axis of the tubular vertical post (11). In a preferred embodiment, the rotational means is one or more wheels and most preferably, a pair of wheels, located on opposite sides of the opening (15) for the tubular vertical post. These wheels (29) may be made of any low rolling resistance, strong, durable material such as plastic, heavy-duty rubber or metal, preferably, a durable plastic. In addition to their rolling movement about the axis of the hollow post, the wheels (29) also rotate about their individual axes, secured within the body of the bottom mounting assembly (14). At least about one-fourth of the wheels project above the top of the bottom mounting assembly (14) to allow the wheels to interact with an upper mounting base assembly (30), the combination of which forms the detent mechanism (28).

The post is also supported by placing it within an upper support bracket (18) which is attached to the inside surface (19) of the cabinet at least about 6 inches above the floor (20) of the cabinet. (See FIGS. 1, 2, 11 and 14.) The upper support bracket (18) is L-shaped with the horizontal portion (21) of the L containing an opening (22) larger than the diameter of the vertical post (11). (See FIG. 3). In operation, the post (11) rests within this opening (22) of the upper support bracket (18). The vertical portion (23) of the L-shaped upper suppory bracket is secured to the inside surface (19) of the cabinet (13) by any conventional securing means such as wood screws.

Although the half-moon shelf assembly can be used with one shelf alone, in a preferred embodiment, two or more shelves are used. When only a single shelf is used, the shape of the upper support bracket is not critical other than that there be an opening of sufficient size to support the hollow vertical post. However, when a second or successive shelves are used, the shape of the support bracket is important. The shape of the horizontal portion (21) of the upper support bracket (18) restricts right hand of left hand rotation of the half-moon shelf depending on the location of the door opening in the cabinet. When a second shelf is used, the two side edges (24, 25) of the horizontal portion (21) of the L-shaped upper support bracket (18) are different in shape. The side edge (24) of the horizontal portion which is away from the door opening projects perpendicularly from the inside surface (19) of the cabinet. The other edge (25), which is shaped, is on the same side as is the door (26), and projects out from the inside surface (19) of the cabinet in the same horizontal plane as does the other side (24). However, after an initial perpendicular section of about one inch, the shaped side projects out at approximately a rounded 45 degree angle, measured from the inside surface of the door when it is closed, from about ¼ to about 2 inches and preferably from about ¼ to about 1 inch. (See FIG. 3.) The remaining section of this side edge (25) of the upper support bracket is perpendicular to the inside surface (19) of the cabinet. Thus, the width of the horizontal portion (21) of the upper support bracket (18) is greater at its end than is the vertical portion (23) of the upper support bracket (18). The purpose of the projection of the side (25) of the bracket is to allow the shelf to swing a full 90 degrees into the door opening without hitting the door when the door is in an open position.

Centered on the horizontal portion (21) of the upper support bracket (18) is the circular opening (22) which supports the tubular vertical post (11). When the vertical portion (23) of the upper support bracket (18) is projecting upward, the shelf can be rotated for a right-handed opening. By rotating the upper support bracket (18) so that the vertical portion (23) of the upper support bracket is now facing down rather than up, the bracket supports a shelf assembly useful in a cabinet with a left-handed opening. In a preferred embodiment, both the vertical portion (23) and the horizontal portion (21) are from about 2 to about 6 inches in length.

In addition to supporting the hollow vertical post (11), the upper support bracket (18) also will support an additional shelf assembly. To support a second shelf, the upper support bracket (18) is secured to the bottom of a second bottom mounting assembly (27) by screws, bolts or other securing means which run through matching openings contained in the upper support bracket and in the second bottom mounting assembly (27). Additional shelves may also be used, each having its own support bracket and bottom mounting assembly. However, for illustration in this embodiment, only two half-moon shelves are used. The second bottom mounting assembly (27) is the same in shape and design as is the bottom mounting assembly (14).

Figure 4:
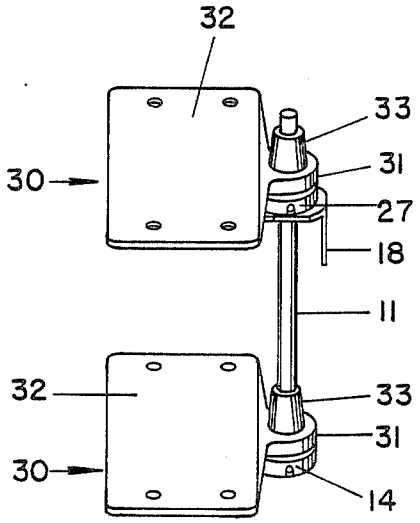
FIG. 4 is a view of two shelf support assemblies attached on a tubular vertical part.
Figure 11:
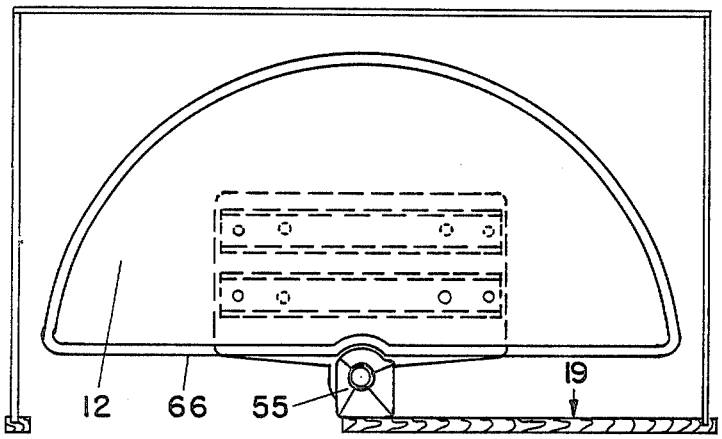
FIG. 11 is a top view of the rotary, half-moon shelf storage assembly utilizing the movement restriction device, with the half-moon shelf in its unrotated position.
Figure 8:
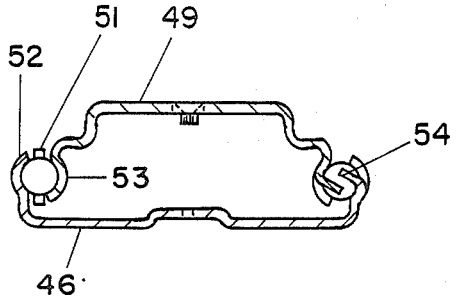
FIG. 8 is an end view of the slide assembly.
Figure 6:
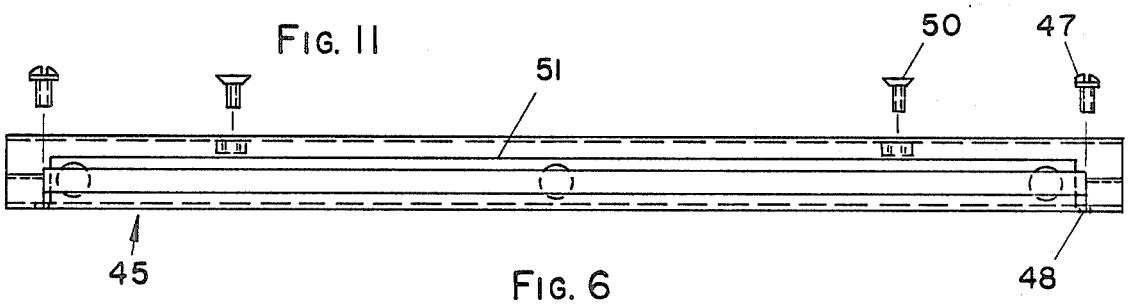
FIG. 6 is a side view of a slide assembly which is secured to the bottom of the half-moon shelf and the top of the shelf support assembly, said slide in its retracted position.
Figure 7:
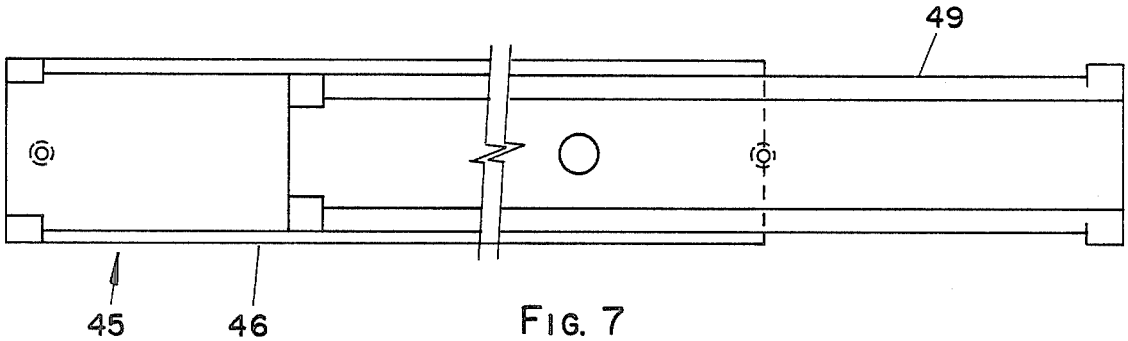
FIG. 7 is a top view of the slide assembly fully extended.

The half-moon shelf is supported by a shelf support assembly (30). (See FIGS. 3 and 4). The shelf support assembly (30) is comprised of a rectangular flat surface (32) to which the half-moon shelf is secured, an upper mounting assembly (31), which interacts with bottom mounting assembly (14) to form the detent mechanism (28) and a hollow tubular section (33) attached to the upper mounting assembly (31), to allow for free rotation of the half-moon shelf about the tubular vertical post (11).

The rectangular flat surface (32) of the shelf support assembly is secured to a half-moon shelf (12) by any conventional securing means. (See FIG. 3). In a preferred embodiment, four openings (34) are provided in the top surface of the shelf (35) and in the rectangular flat surface (32) through which fasteners (36), such as screws or bolts, are inserted to securely attach the shelf to the rectangular flat surface (32) of the shelf support assembly (30). Plastic caps (68) containing openings for a device for securing the fasteners fit into these openings after the fasteners are secured in place. These plastic caps partially cover the fasteners and make a generally smooth shelf. In a preferred embodiment, the length (37) of that portion of the rectangular flat surface (32) which is parallel to the flat side (66) of a half-moon shelf, is at least one-third of the length of flat side (66) of the shelf to provide adequate support for the shelf and prevent it from undesired vertical deflection. In a more preferred embodiment, the width of the rectangular portion of the shelf support assembly is approximately one-half the length of the flat side (66) of the half-moon shelf.

In a preferred embodiment, the width of the rectangular portion of the shelf support assembly should be at least about one-third of the radius of the half-moon shelf to again provide sufficient support for the shelf. The upper mounting assembly (31) can be made of any strong, durable material of sufficient strength to support the half moon shelf. In a preferred embodiment, the shelf support assembly is comprised of molded plastic or cast aluminum.

The half-moon shelf itself can be made of any material, such as molded plastic, metal or wood. In a preferred embodiment the shelf is molded plastic with a solid non-spill through surface and a ribbed support structure. The size of the shelf is dependent upon the size of the cabinet. The ends of the flat side (66) of the shelf are rounded to prevent damage to the inside surface of the cabinet door. (See FIGS. 1 and 2.)

Adjacent to the rectangular flat surface (32) of the shelf support assembly (30) and attached thereto is the counterpart to the bottom mounting assembly (14), i.e., the upper mounting assembly (31). The interaction of the upper mounting assembly (31) and the bottom mounting assembly (14) creates the detent mechanism (28) for releasably holding each shelf in a set position and for returning the shelf to that set position if it is reasonably close to that set position. (See FIG. 5). The bottom surface of the upper mounting assembly defines a course (38) which contains peaks (39) and valleys (40) about which the wheels (29) of the bottom mounting assembly (14) rotate.

These valleys (40) are located 90 degrees apart from each other on the course (38) and are of the same depth. Between any two of these valleys (40), the surface of the course (38) rises to a peak (39) and then descends to the next valley (40). When the wheels (29) of the bottom mounting assembly (14) rotate away from the valleys (40) they rise up to the peaks (39) where they descend to the next valley (40). The surface of the shelf itself will rise as the upper mounting assembly (31) rises. In operation, once the shelf is rotated partially, it will tend to return to its home position or to a position 90 degrees away from home because of the gravitational interaction between the valleys (40) and the wheels (29) of the detent mechanism (28). (See FIG. 5).

Running from the middle of the bottom surface of the upper mounting base assembly (31) through the upper mounting base assembly is a hollow tubular section (33) through which the tubular vertical post (11) projects. The lower opening (41) for this tubular vertical post in the hollow tubular section (33) is only slightly larger than the diameter of the tubular vertical post (11) to provide for a close fit. To achieve less resistance in the rotation of the shelves and to prevent undesirable noise when the shelf is rotating, a ring (42) of a material, similar in composition to that used in manufacture of the wheels (29) of the bottom mounting assembly (14) is provided, which fits within the opening (41) in the hollow tubular section (33). A second upper opening (43) in the hollow tubular section (33) is provided above the first opening (41) within the hollow tubular section (33), a sufficient distance away from the first opening (41) so as to support the shelf. (See FIG. 3). In a preferred embodiment this distance is from about 3 to about 6 inches. An additional plastic ring (44) is provided within this second opening (43) to allow easy axial rotation of the shelf about the axis of the tubular vertical post. The hollow tubular section can be of any appropriate diameter, preferably from about 1 to about 3 inches. (See FIGS. 3 and 5).

By separately attaching each shelf support assembly with attached shelf to the post, a plurality of shelf support assemblies may be secured to the post, each shelf support assembly rotatable around the axis of the post independently of each other shelf support assembly.

Although the shelf (12) may attach directly to the rectangular flat surface (32) of the shelf support assembly, in a preferred embodiment, a pair of slide assemblies (45) are connected between the shelf (12) and the rectangular flat surface (32) of the shelf support assembly (30) to allow the shelf to slidably extend from the cabinet. (See FIGS. 6, 7, 8, 11 and 12). The channel (46) of the slide assembly, is connected to the rectangular flat surface (32) of the shelf support assembly (30) by any conventional connecting means such as bolts, welding or other connecting means. In a preferred embodiment, the channel (46) is connected by metal bolts (47) running through openings (48) in the channel (46) into the rectangular flat surface (32) of the shelf support assembly. The upper portion of the slide assembly, the track (49), is connected to the underside of the shelf by any conventional fastening means. In a preferred embodiment the fastening means is metal bolts (50). Although the slide assembly (45) can be of any conventional design with sliding means operable by wheels, ball bearings, or other conventional slide means, in a preferred embodiment, a conventional ball bearing retainer strip (51) is provided between the outside of the track (52) and the inside of the channel (53) on each side of the slide assembly (45). Slide restriction devices (54) such as stops or blocks attached to the end of the track (49) or channel (46) are located to prevent the shelves (12) from being pulled off of their slide.

Figure 9:
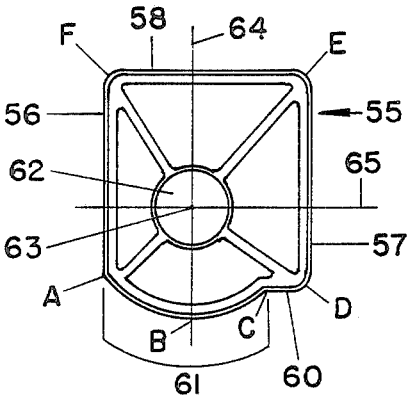
FIG. 9 is a top view of a movement restriction device.
Figure 10:
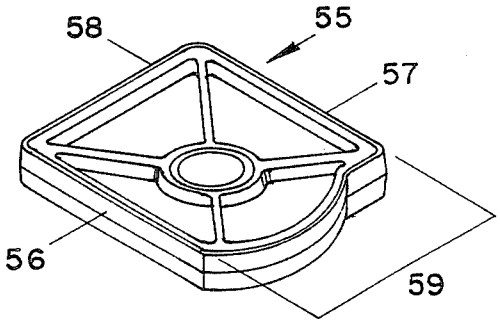
FIG. 10 is a side prospective view of the movement restriction device.
Figure 12:
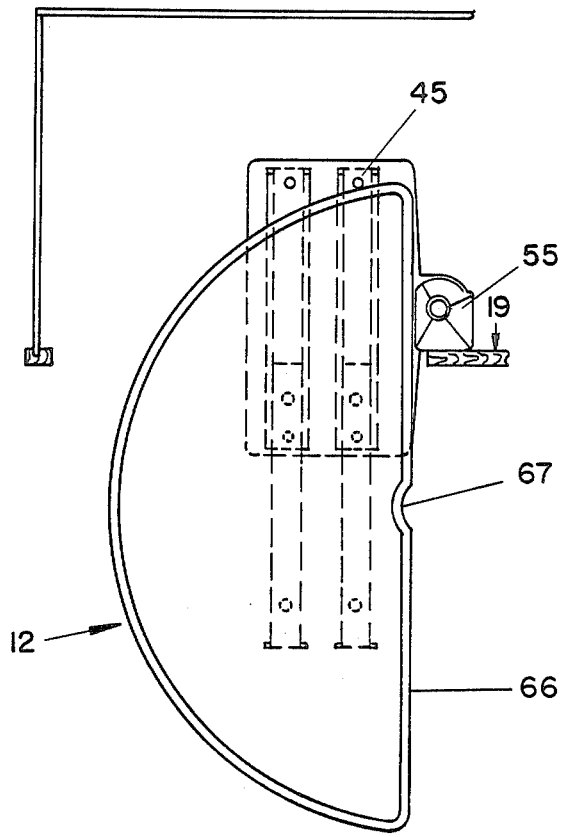
FIG. 12 is a top view of the rotary half-moon shelf storage assembly utilizing the movement restriction device, with one shelf extended.

In the preferred embodiment, when slide assemblies (45) are used, there may also be provided a rotation restriction device (55) for the shelf. See FIGS. 9 and 10. Above the upper mounting base assembly (31) on the tubular vertical post (11) is located the rotational restriction device (55). It is generally rectangular in shape with three flat sides, the first side (57) and the second sides (56) are longer than the third flat side (58). The fourth side (59), opposite the shortest of the three other sides, is comprised of two sections, a smaller flat portion (60) parallel to the third flat side (58) and an arc (61) defined by points A, B and C on FIG. 9. Located within the rotation restriction device is an opening (62) through which the post (11) fits. The shape of the arc (61) is defined as that portion of a circle with its center point being the center of the opening (62), and radius running to the edge of the arc (60). The arc runs from the inside end of the smaller flat portion (60) to the end of the fourth side (shown as point A on FIG. 9). The opening (62) in the rotation restriction device is not located in the center of the device but rather closer to the arc (61) than to the third flat side (58) of device. In addition, the opening (62) is located further from the first side (57) which meets the short flat portion (60) of the fourth side (59) than the second side (56) of the device. The short flat portion of the fourth side (59) comprises approximately 1/6 to ¼ of the length of that fourth side (59).

In a preferred embodiment, the center point (63) of the opening (62) is located at a point approximately where two lines intersect. The first of those lines (64) is a line running approximately from the highest portion of the arc (61) through the third flat side (58) and perpendicular thereto. The second of those lines (65) is a line located approximately parallel to the cord AC on the fourth side (59) and at a distance from the center of the opening (63) to cord AC which is equal to the distance from the center of the opening to the second side (56).

Figure 13:
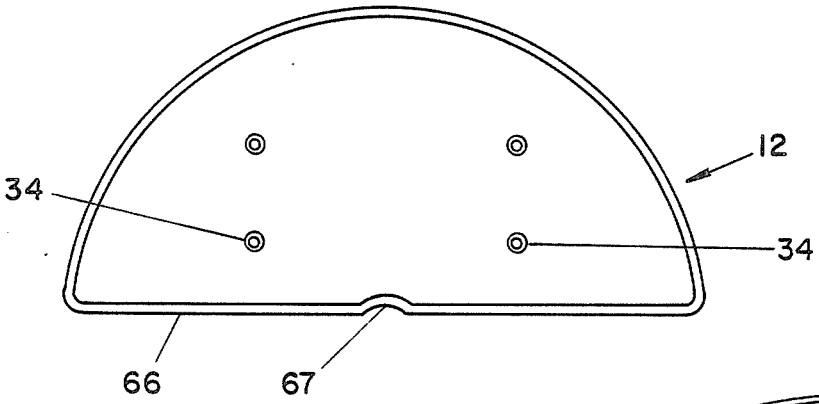
FIG. 13 is a top view of a half-moon shelf for use with a movement restriction device.
Figure 14:
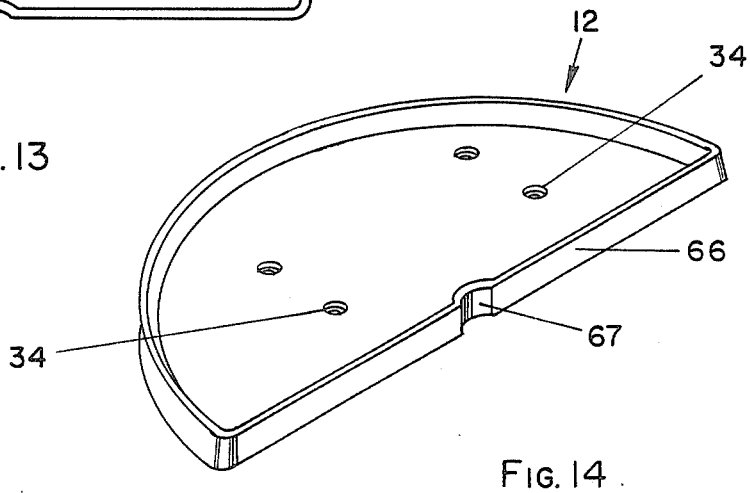
FIG. 14 is a prospective view of a half-moon shelf for use with a movement restriction device.

When a movement restrictive means is in operation, the flat side (66) of the half-moon shelf (12) has a small cut-out (67) which is designed to allow the arc (61) of the rotation restriction device (55) to fit within the cut-out (67) of flat side (66) of the half-moon shelf. (See FIGS. 11, 12 and 13). Obviously, the hollow tubular section (33) attached to the upper mounting assembly (31) must be shorter than the flat side (66) of the shelf so that the rotation restriction device (55) will interact with the flat side (66) of the shelf.

In operation, the third flat side (58) of the rotation restriction device (55) rests against the inner surface (19) of the cabinet. (See FIGS. 11 and 12). The smaller flat portion (60) of the fourth side (59) of the rotation restriction device, defined by the line CD, prevents the shelf from destructively rotating while in the cabinet. (See FIG. 11). There being no flat portion on the opposite side of that fourth side (59) of the rotation restriction device (55), the half-moon shelf (12) can rotate approximately 90 degrees about the axis of the tubular vertical post (11). It is prevented from further rotation by the second side (56) of the device. As long as the flat side of the shelf (66) rests against the second side (56) it cannot rotate further than 90 degrees (See FIGS. 11 and 12).

In a preferred embodiment, when a pair of slide assemblies (45) are attached to the bottom of the shelf, the shelf (12) even when pulled from the cabinet is still prevented from rotation by the rotation restriction device (55). By means of this device (55), the only allowed rotation of the shelf (12) is the 90 degree turn when the shelf is axially rotated about the tubular vertical post. This rotation restriction device (55) can be used in either left-handed or right-handed cabinets, i.e, where the opening is either on the left side of the cabinet or on the right side of the cabinet. For use in opposite sides, the rotation restriction device is merely turned over so that the short flat portion (60), defined by the letters CD, is on the opposite side of the tubular vertical post.

In operation, the bottom mounting assembly (14) is secured to the floor (20) of the cabinet (13) by conventional securing means, such as screws and the tubular vertical post (11) is placed within the circular opening (15) in the bottom mounting assembly (14). The tubular vertical post is prevented from rotation by securing a set screw (17) running through the aperture (16) in the bottom mounting assembly (14) to contact the threaded surface of the post. A rotary half-moon shelf (12) secured to an upper mounting assembly (31) is placed over the post until it rests on the bottom mounting assembly (14). The bottom mounting assembly (14) contains the bottom portion of a detent mechanism (28) with the upper mounting base assembly (31) containing the upper portion of the detent mechanism (28). This detent mechanism allows the shelf to rotate while tending to return the shelf to its home position after the shelf is placed over the post (11). An L-shaped upper support bracket (18) is placed over the post and secured to the inside surface (19) of the cabinet. The upper supported bracket (18) prevents undesired movement of the post (11) while also providing a second base to secure a second bottom mounting assembly (27) for a second shelf.

In the preferred embodiment, a pair of slide assemblies (45) are secured between the bottom of the half-moon shelf (12) and the rectangular flat surface (32) of the upper mounting assembly to allow the shelf to be extended from the cabinet. There is also placed on the tubular vertical post (11) a rotation restriction device (55). One portion of the fourth side (59) of the rotation restriction device (55) is arc shaped (61), which arc interacts with a cut-out (67) on the flat side (66) of the half-moon shelf (12). By this interaction, the half-moon shelf is prevented from destructive rotation both in the cabinet and when it is pulled out of the cabinet on its slides.

I claim:

1. A rotary half-moon shelf storage device for use within a cabinet having a front and a floor wherein the cabinet has partial frontal access, comprising:

a. a tubular vertical post supported by an upper support bracket secured to the inner surface of the front of the cabinet at least about 6 inches above the floor of the cabinet;

b. a securing means for securing the post to the floor of the cabinet;

c. a half-moon support means rotatably connected to the post allowing rotation about the axis of the post;

d. a shelf, slidably secured to the shelf support means by an extension and retraction means secured to the bottom of the shelf and the top of the shelf support means; and e. a rotation restriction means placed around the post for limiting rotation of the half-moon shelf about the axis of the post to about 90 degrees.

2. The rotary half-moon shelf storage device for use within a cabinet having partial frontal access of claim 1 wherein the post is a hollow tubular vertical post.

3. The rotary half-moon shelf storage device for use within a cabinet having partial frontal access of claim 2 wherein the post is connected to the floor of the cabinet by a bottom mounting assembly means.

4. The rotary half-moon shelf storage device for use within a cabinet having partial frontal access of claim 3 wherein the bottom mounting assembly means is comprised of:

a. an opening for insertion of the post means;

b. an aperture running through the bottom mounting assembly means for insertion of a set screw which can be secured against the side of the post to prevent rotation of the post about its axis; and c. a lower portion of a detent means.

5. The rotary half-moon shelf storage device for use within a cabinet having partial frontal access of claim 4 wherein the half-moon shelf is retained in a predetermined angular position relative to the post by the detent means which is comprised of:

a. one or more rotational means contained within the bottom mounting assembly means located on opposite sides of an opening for the post contained within the bottom mounting assembly means and arranged so as to roll about the axis of a line running through the opening for the post; and b. an upper mounting base assembly means, which is a part of the half-moon shelf support means, the bottom surface of which contains a ring which defines a course for the rotational means to rotate, which contains peaks and valleys, said combination of bottom mounting assembly means and bottom surface of the upper mounting base assembly means allowing the half-moon shelf to rotate releasably in a predetermined position about the post.

6. The rotary half-moon shelf storage device for use within a cabinet having partial frontal access of claim 5 wherein the rotational means is one or more rotating wheels made of any low rolling resistant, strong, durable material, such as plastic, heavy-duty rubber or metal.

7. The rotary half-moon shelf storage device for use within a cabinet having partial frontal access of claim 2 wherein the shelf support means comprises:

a. a rectangular flat surface for supporting the shelf, wherein said rectangular surface is of sufficient size to prevent undesired vertical deflection of the half-moon shelf;

b. an upper mounting base assembly means which interacts with the bottom mounting assembly means to form the detent means; and c. a hollow tubular section running through the upper mounting base assembly means to allow rotation of the shelf support means around the axis of the post.

8. The rotary half-moon shelf storage device for use within a cabinet having partial frontal access of claim 1 wherein the half-moon shelf support means comprises:

a. a rectangular flat surface for supporting the shelf, wherein said rectangular surface is of sufficient size to prevent undesired vertical deflection of the half-moon shelf;

b. an upper mounting base assembly means which interacts with the bottom mounting assembly means to form the detent means;

c. a hollow tubular section running through the upper mounting base assembly means to allow rotation of the shelf support means around the axis of the post; and d. an extension and retraction means secured to the bottom of the half-moon shelf and to the top of the rectangular flat surface to allow extension and retraction of the shelf from the cabinet.

9. The half-moon shelf storage device for use within a cabinet having partial frontal access of claim 8 wherein the length of the rectangular flat surface which is parallel to the flat side of the half-moon shelf is at least about one-third the length of the flat side of the half-moon shelf and the width of the rectangular flat surface is at least one-third of the radius of the half-moon shelf.

10. The rotary half-moon shelf storage device for use within a cabinet having partial frontal access of claim 1 wherein the half-moon shelf is comprised of molded plastic.

11. The rotary half-moon shelf storage device for use within a cabinet having partial frontal access of claim 9 wherein the extension and retraction means is comprised of a pair of mounted slides which are secured to the bottom of the half-moon shelf and the top of the rectangular flat surface to support the half-moon shelf.

12. The rotary half-moon shelf storage device for use within a cabinet having partial frontal access of claim 1 wherein a plurality of shelves are secured to the post, each shelf rotatable around the axis of the post means independent of each other shelf.

13. The rotary half-moon shelf storage device for use within a cabinet having partial frontal access of claim 1 wherein the rotation restriction means prevents the half-moon shelf from rotating within the cabinet so as to collide with any portion of the inner surface of the cabinet except the inner surface of the door of the cabinet when the door is closed.

14. The rotary half-moon shelf storage device for use within a cabinet having partial frontal access of claim 1 wherein the rotation restriction means prevents the half-moon shelf from rotating when the half-moon shelf is slidably extended from the cabinet.

15. The rotary half-moon shelf storage device for use within a cabinet having partial frontal access of claim 1 wherein the rotation restriction means is placed above the upper mounting base assembly on the post.

16. The rotary half-moon shelf storage device for use within a cabinet having partial frontal access of claim 1 wherein the movement restriction means contains an opening to allow the rotation restriction means to fit over the post and is generally rectangular in shape with three flat sides, two of them longer than the third flat side, and the fourth side opposite the third flat side comprised of two sections, a small flat portion comprising approximately 1/6 to ¼ of the distance across the fourth side which is parallel to the third flat side and an arc.

17. The rotary half-moon shelf storage device for use within a cabinet having partial frontal access of claim 16 wherein the shape of the arc is defined as that portion of a circle with its center point being the center of the opening in the movement restriction means and its radius running to the edge of the arc, with the arc running from the end of the fourth side away from the small flat portion to the inside edge of the small flat portion of the fourth side.

18. The rotary half-moon shelf storage device for use within a cabinet having partial frontal access of claim 1 wherein the flat side of the half-moon shelf has a cut-out which interacts with the arc of the movement restriction means to allow the half-moon shelf to restrictively rotate about the axis of the post.

19. A rotary half-moon shelf storage device for use within a cabinet having a front and a floor wherein the cabinet has partial frontal access comprising:

a. a tubular vertical post supported by an upper support bracket secured to the inner surface of the front of the cabinet at least about 6 inches above the floor of the cabinet;

b. a securing means for securing the post the floor of the cabinet;

c. a half-moon shelf support means rotatably connected to the post comprised of a rectangular flat surface, an upper mounting base assembly means which interacts with a bottom mounting assembly means to form a detent means and a hollow tubular section running through the upper mounting base assembly means to allow rotation of the shelf support means around the axis of the post;

d. a shelf slidably secured to the shelf support means by an extension and retraction means secured to the bottom of the shelf and the top of the shelf support means; and e. a rotation restriction means placed around the post for limiting the rotation of the half-moon shelf about the axis of the post means to about 90 degrees.

20. The rotary half-moon shelf storage device for use within a cabinet having partial frontal access as in any of claims 1 or 19 wherein the shelf is generally semicircular in shape.

21. The rotary half-moon shelf storage device for use within a cabinet having partial frontal access as in any of claims 1 or 19 wherein the shelf can extend from the cabinet by an extension and retraction means.

22. The rotary half-moon shelf storage device for use within a cabinet having partial frontal access as in any of claims 1 or 19 wherein the shelf is molded plastic with a solid, non-spill through surface and a ribbed support structure.

23. The rotary half-moon shelf storage device for use within a cabinet having partial frontal access as in any of claims 1 or 19 wherein the ends of the flat side of the shelf are rounded to prevent damage to the inside surface of the cabinet door.

* * * * *